United States Patent [19]

Ripley

[11] Patent Number: 4,900,233

[45] Date of Patent: Feb. 13, 1990

[54] RECIPROCATING COMPRESSOR PROVIDING A LUBRICANT FREE COMPRESSED GAS

[75] Inventor: David L. Ripley, San Diego, Calif.

[73] Assignee: Sundstrand Corporation, Rockford, Ill.

[21] Appl. No.: 201,627

[22] Filed: Jun. 2, 1988

[51] Int. Cl.[4] ..... F04F 7/02

[52] U.S. Cl. ..... 417/266; 74/18.2; 92/72; 92/153; 92/165 R; 184/24; 417/273

[58] Field of Search ..... 417/273, 244, 266; 184/24; 92/165 R, 35, 44, 34, 153, 72, 68; 74/18.2

[56] References Cited

U.S. PATENT DOCUMENTS

| | | | |
|---|---|---|---|
| 2,711,137 | 6/1955 | Moller | 74/18.2 X |
| 2,839,241 | 6/1958 | Kurtz | 74/18.2 X |
| 3,299,828 | 1/1967 | Josephian | 74/18.2 X |
| 3,503,304 | 3/1970 | Comeau, Jr. et al. . | |
| 3,550,991 | 12/1970 | Wesoloski . | |
| 3,817,663 | 6/1974 | Zehner | 92/160 X |
| 4,116,115 | 9/1978 | Gross et al. . | |
| 4,222,310 | 9/1980 | Garrett et al. . | |
| 4,268,042 | 5/1981 | Borlan . | |
| 4,556,369 | 12/1985 | Braun | 74/18.2 X |
| 4,615,259 | 10/1986 | Anbe | 417/536 X |

FOREIGN PATENT DOCUMENTS

| | | |
|---|---|---|
| 1491446 | 7/1967 | France . |
| 2316517 | 1/1977 | France . |

*Primary Examiner*—Edward K. Look

*Attorney, Agent, or Firm*—Wood, Dalton, Phillips, Mason & Rowe

[57] ABSTRACT

The presence of a lubricant in compressed gas from a reciprocating compressor including at least one cylinder 76 reciprocally receiving a piston 74 mounted on a rod 60 and connected to a rotary shaft 12 by a rotary to reciprocating motion converting mechanism 44 is avoided by placing a bellows 130 between the cylinder 76 and various components, including a piston rod guide 64, requiring lubrication.

8 Claims, 3 Drawing Sheets

FIG. 1
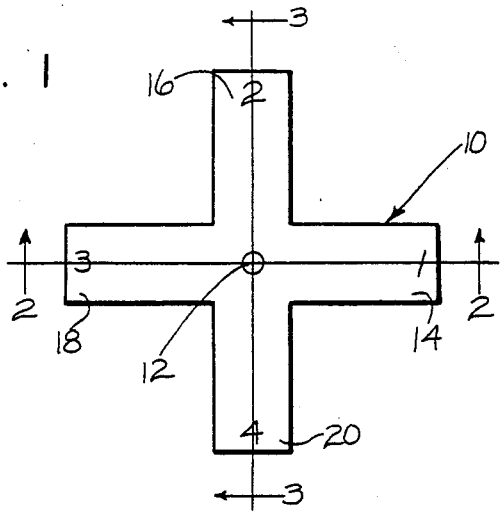
FIG. 4
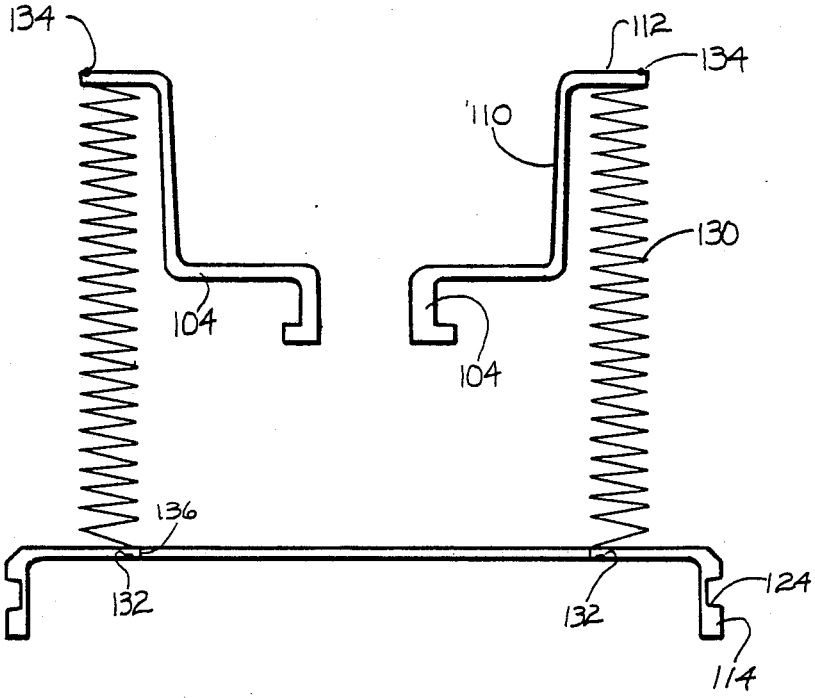
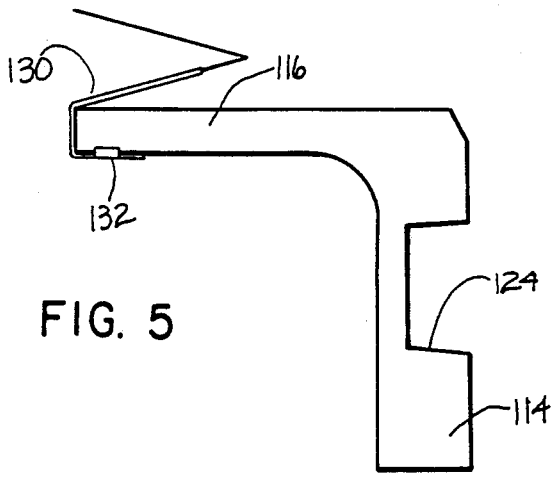
FIG. 5

RECIPROCATING COMPRESSOR PROVIDING A LUBRICANT FREE COMPRESSED GAS

FIELD OF THE INVENTION

This invention relates to reciprocating compressors, and more particularly, to a reciprocating compressor that can compress a gas without adding a lubricant thereto.

BACKGROUND OF THE INVENTION

There are many applications requiring compressed gases that are not contaminated by lubricants utilized to lubricate a reciprocating compressor employed to compress the gas. Conventionally, compressors utilized to provide an oil or lubricant free compressed gas use oil scrapers and seals to prevent crankcase lubricant from migrating to an oil free zone wherein oil free gas is compressed and delivered.

Quite typically, the seals and/or scrapers, though highly efficient, are incapable of halting the flow of all of the oil or lubricant. In short, some oil or lubricant vapor inevitably migrates past the seals and contaminates the gas. While good compressor design will keep the oil contamination low, and filters downstream of the compressor may be utilized to separate the lubricant from the gas to provide a desired relatively free compressed gas product, it would be desirable to eliminate the need for downstream treatment and the maintenance that is associated therewith. The present invention is directed to solving the above problem.

SUMMARY OF THE INVENTION

It is the principal object of the invention to provide a new and improved reciprocating compressor that provides a stream of compressed gas that is completely oil free.

An exemplary embodiment of the invention achieves the foregoing object in a reciprocating compressor including a housing with means defining at least one cylinder. A piston is reciprocally received in a cylinder and a drive shaft is journaled in the housing. A piston rod is connected to the piston and extends toward the drive shaft and a rotary to reciprocating motion converting mechanism interconnects the piston rod and the drive shaft so that rotation of the drive shaft will cause reciprocation of the piston. Means are provided for directing a liquid lubricant to the mechanism to lubricate the same and a means is provided for positively isolating the cylinder from the liquid lubricant for all positions of the piston within the cylinder. The isolating means includes a bellows having opposed ends and which surrounds the piston rod between the piston and the converting mechanism. The radially inner end of the bellows is secured and sealed to the piston rod and movable therewith while the radially outer end of the bellows is secured and sealed to the housing about the cylinder.

As a result of the foregoing, the bellows completely isolates the low pressure side of the system from the lubricant source. Consequently, lubricant cannot find its way to the cylinder wall to move past the skirt of the piston into the compression part of the cylinder to contaminate the gas being compressed therein.

In a highly preferred embodiment, the mechanism includes a piston rod guide located radially outward of the converting mechanism for guiding the piston rod in a straight line path and the liquid lubricant providing means additionally provides the liquid lubricant to the rod guide to lubricate the same.

In a highly preferred embodiment, the rod guide surrounds the piston rod and has a predetermined outer periphery. The radially inner end of the bellows is mounted to a cup-like web carried by the rod. The cup-like web has a concave end facing the rod guide and is shaped so as to be capable of nesting compactly about the rod guide. The concave end of the web is surrounded by a peripheral lip to which the radially inner end of the bellows is secured and sealed such that the remainder of the cup-like web is within the bellows.

According to a preferred embodiment of the invention, the cylinder includes a external peripheral lip intermediate its ends and the bellows is constructed to compactly nest about the exterior of the cylinder with the radially outer end being secured and sealed to the peripheral lip.

The invention also contemplates the provision of a web carried by the rod and having an outer periphery to which the radially inner end of the bellows is secured and sealed along with an inner collar through which the rod extends. The inner collar is located on the cylinder side of the web and has a periphery that is sufficiently small that it may enter the cylinder as the rod reciprocates.

As a result of one or more of the foregoing features, a bellows of sufficient length as to readily accommodate the full stroke of the piston without being unduly stressed, either in compression or tension, can be easily fitted to the compressor without unduly increasing the size thereof.

In a highly preferred embodiment, the compressor is a multiple stage compressor having plural cylinders, plural pistons, plural piston rods, plural rod guides and plural bellows, and the converting mechanism is constructed and arranged to phase the pistons in a uniform manner. In addition, the housing includes at least one passage establishing fluid communication between the areas within the housing about each piston rod between the associated bellows and the associated rod guide. As a consequence, air within such areas that would otherwise be compressed during operation of the machine may be shuttled from a contracting area to an expanding one. This in turn minimizes the pressure differential that will exist cross the various bellows and extends their life.

Other objects and advantages will become apparent from the following specification taken in connection with the accompanying drawings.

DESCRIPTION OF THE DRAWINGS

FIG. 1 is an extremely schematic plan view of a reciprocating compressor made according to the invention;

FIG. 4 is a sectional view of a bellows subassembly utilizing the invention; and FIG. 5 is an enlarged, fragmentary view of part of the bellows assembly.

DESCRIPTION OF THE PREFERRED EMBODIMENT

Figure 2:
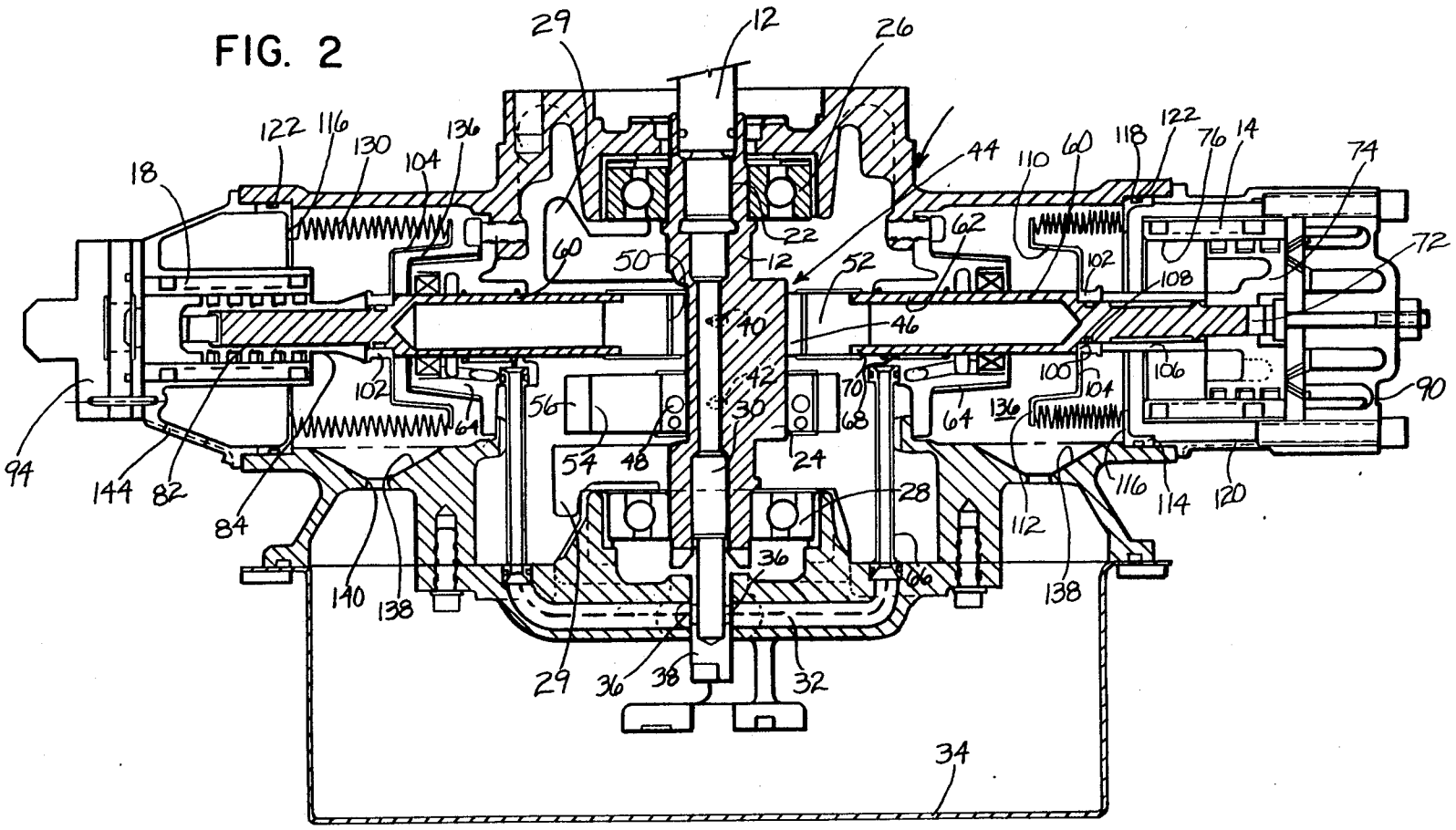
FIG. 2 is a vertical section of the compressor taken approximately along the line 2—2 in FIG. 1.

An exemplary embodiment of reciprocating compressor made according to the invention is illustrated in highly schematic form in FIG. 1 and is seen to include a housing, generally designated 10 journaling a vertical shaft 12. The housing 10 includes four compression zones 14, 16, 18 and 20, the first zone 14 being a low pressure compression zone, the second zone 16 being a low intermediate pressure compression zone, the third 18 being a high intermediate pressure compression zone and the fourth zone 20 being a high pressure compression zone. As is well known in the art, gas to be compressed is first compressed in the zone 14 and then conveyed to the zone 16 for further compression. After being compressed in the zone 16, it is compressed further in the zone 18 and finally compressed again in the zone 20. Suitable valving and interconnections of the various zones to achieve the foregoing are well known in the art and form no part of the present invention. It is, to be noted however, that in relation to the shaft 12, the zones 14, 16, 18 and 20 extend radially therefrom and are equally angularly spaced from one another in 90° increments.

Figure 3:
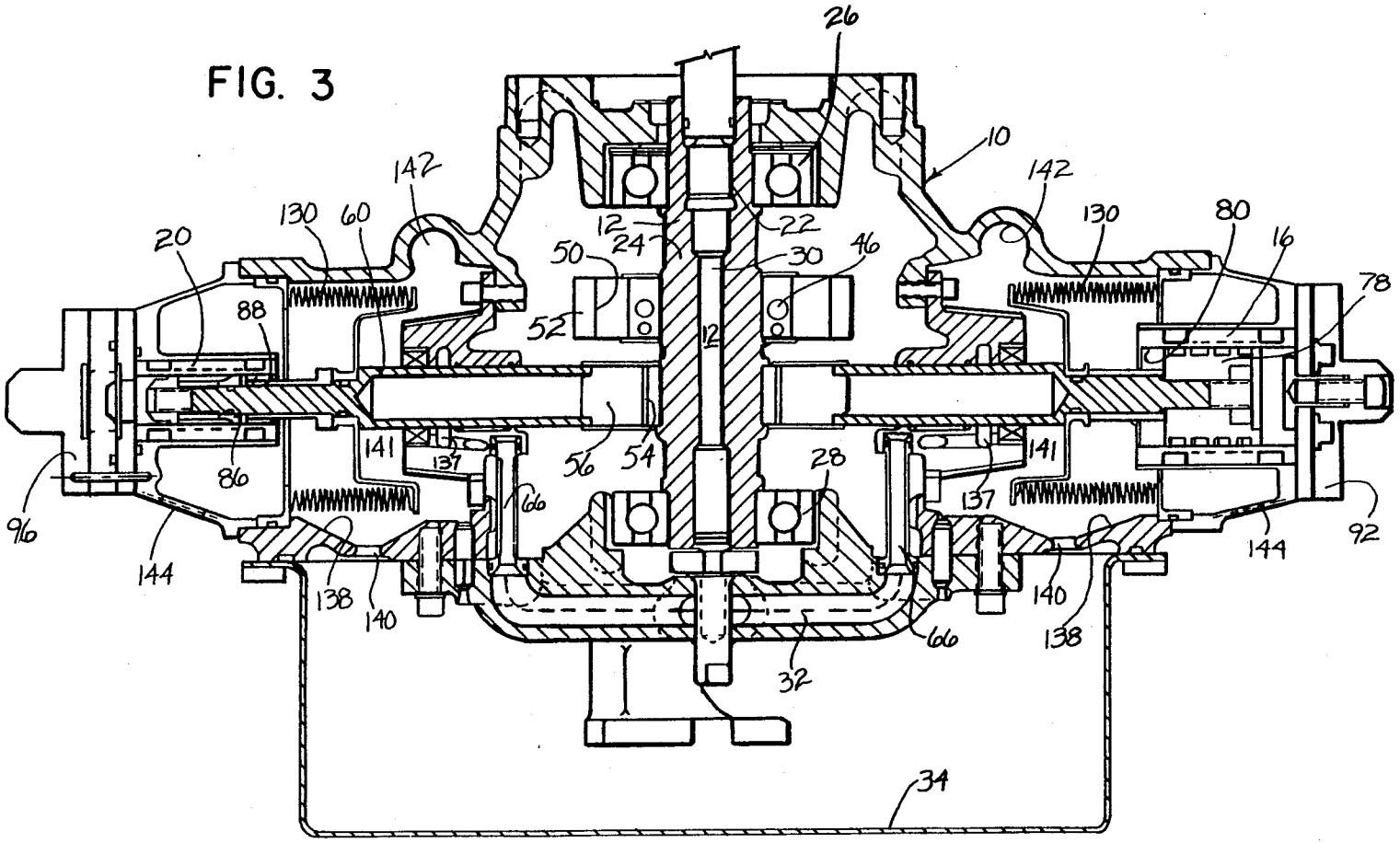
FIG. 3 is another vertical section of the compressor but taken at right angles to the section illustrated in FIG. 2 and approximately along the line 3—3 in FIG. 1.

Turning now to FIGS. 2 and 3, the shaft 12, which is adapted to be connected to a motor or the like by means not shown, includes a spline connection 22 to an eccentric 24 (best seen in FIG. 2) which in turn is journaled at its opposite ends by bearings 26 and 28 and which includes integral counterweights 29. The bearings 26 and 28 are fitted to the housing 10 in the manner illustrated in FIGS. 2 and 3.

The eccentric 24 includes a central lubricant passage 30 which is in fluid communication with a lubricant manifold 32 in the lower part of the housing and located just above a sump defined by an oil pan 34. A conventional pump (not shown) in fluid communication with the sump 34 is adapted to provide oil under pressure to the manifold 32. By means of radial apertures 36 formed in a transfer tube 38 which in turn is in fluid communication with the passage 30, oil under pressure is directed into the passage 30 and may exit the same via radial passages 40 and 42 to lubricate a rotary to reciprocating motion converting mechanism, generally designated 44, which includes the eccentric 24.

The mechanism 44, is a conventional so-called "scotch yoke" mechanism and includes first and second, generally rectangular blocks 46 (FIG. 3) and 48 (FIG. 2) which are respectively aligned with the oil passages 40 and 42 and which are journaled on axially spaced parts of eccentric 24. The block 46 is slidable in an elongated, rectangular slot 50 in a yoke plate 52 while the block 48 is similarly mounted for reciprocation in an elongated slot 54 in a yoke plate 56.

Because of the effect of the eccentric 24, the yoke plate 52 will reciprocate from right to left as viewed in FIG. 2 while the yoke plate 56 will reciprocate in and out of the paper as viewed in FIG. 2. This motion of the yoke plate 52 is utilized to provide for compression in the zones 14 and 18 while the movement of the yoke plate 56 is utilized to provide compression in the zones 16 and 20.

Because many of the components utilized in each of the zones 14, 16, 18 and 20 are identical from one zone to another, only such components as are employed in the zone 14 will be described, it being understood that like components are employed elsewhere with the exception of some differences in cylinder construction to be described hereinafter.

As alluded to earlier, the yoke plate 52 reciprocates from right to left as viewed in FIG. 2. On the right hand side thereof as viewed in that FIG., there is located a piston rod 60 which is reciprocatingly received in a bore 62 of a rod guide 64. The rod guide 64 is mounted to the housing 10 by any suitable means and has a frustoconical outer surface. A tube 66 is in fluid communication with the manifold 32 and extends to a lubricant port 68 opening to the bore 62. Thus, lubricant under pressure is directed to the bore 62 to lubricate the interface of the piston rod 62 and the rod guide 64.

The radially inner end 70 of the piston rod 60 is secured by any suitable means to the right hand side of the yoke plate 52. One hundred and eighty degrees about the shaft 12, a similar rod 60 is secured to the left hand side of the yoke plate 52 and extends toward the compression zone 18. As a result of the foregoing construction, there are a plurality of piston rods 60 that are each mounted for straight line movement in respective rod guides 64.

Each piston rod 60, at its end 72 opposite the converting mechanism 44 mounts a piston in an associated cylinder. In the zone 14, the piston is indicated at 74 and the cylinder at 76. It will be noted that both the piston 74 and the cylinder 76 received the same are relatively large. Turning to FIG. 3, a somewhat smaller piston 78 is reciprocally received within a somewhat smaller bore or cylinder 80 in the zone 16.

Returning to FIG. 2., an even smaller piston 82 is reciprocally received in an associated cylinder 84 while FIG. 3 illustrates the smallest one of the pistons 86 received in a cylinder 88. Thus, the largest piston 74 is for the lowest pressure zone 14 while the smallest piston 86 is for the highest pressure zone 20 as is customary in multiple stage reciprocating compressors of this sort. The purpose is, of course, to achieve high volumetric efficiency, and secondarily, to tend to equalize the loading ultimately placed on the drive for the shaft 12, irrespective of which piston is compressing fluid in its respective cylinder at a given point in time.

Each of the cylinders 76, 80, 84 and 88 is closed oppositely of the eccentric 24 by a respective head 90, 92, 94 and 96. The specific configuration of the heads 90, 92, 94 and 96 forms no part of the invention but it is noted that they are conventionally provided with passages and valves and are interconnected in such a way as to convey the air compressed at a lower stage to the next higher stage for further compression.

As seen in FIG. 2, each rod 60 includes a radially outwardly facing shoulder 100 against which is abutted an integral collar 102 of a cup-like web 104. A sleeve 106 abuts the collar 102 oppositely of the shoulder 108 and is held in place by the piston 74. Thus, the web 104 is mounted on the rod 60 for movement therewith at a location between the piston 74 and the associated rod guide 64.

The web 104, save for the opening in the collar 102, is imperforate so that oil cannot leak therethrough. In order to prevent any oil from leaking through the interface of the rod 60 and the collar 102, that interface is provided with an O-ring seal 108.

As mentioned earlier, the web 104 is cup-shaped and has a concave opening 110 facing the rod guide 64 and in turn surrounded by a peripheral lip 112. The concave opening 110 is such that the web 104 may nest compactly about the associated rod guide 64. See, for example, the web 104 and rod guide 64 associated with the zone 18 on the left hand side of FIG. 2.

A circular mounting flange 114 includes a peripheral lip 116 which is aligned with the lip 112. The mounting flange 114 is abutted against a shoulder 118 on the housing 10 and held in place by part of a casting 120 which includes a corresponding one of the cylinders 76, 80, 84 and 88. This interface is sealed by an O-ring seal 122.

Preferably, an outwardly opening groove 124 (best seen in FIGS. 4 and 5) is provided in the flange 114 for the purpose of receiving the O-ring seal 122.

As seen in the various FIGURES, a generally cylindrical bellows 130 of pleated or accordion-like configuration is mounted to the lips 112 and 116 and more specifically, is sealed and secured thereto as by a peripheral weld 132 to the lip 116 and by a similar peripheral weld 134 to the lip 112. As a consequence, a unitary bellows subassembly including the ring 114, the web 104 and the bellows 130 is defined with the bellows 130 being sealed and secured to each of the cup 104 and the flange 114 about the entire periphery of the lips 112 and 116.

As can be seen in various locations in both FIGS. 2 and 3, the ring 114 is provided with a central opening 136 that is of larger diameter than the corresponding piston. In the preferred embodiment, to minimize the number of parts that are required in forming the compressor, each of the bellows subassemblies is identical one to the other; and that in turn means that the opening 136 will be of somewhat greater diameter than the piston 74 as can be plainly seen in the right hand side of FIG. 2.

In the case of the zones 16 and 18, the cylinders 80 and 84 extend inwardly toward the shaft 12 through the opening 36 in the associated flange 114 meaning in turn that the lip 116 will be on the exterior of the corresponding cylinder and intermediate the ends thereof.

In each of the zones 14, 16, 18 and 20, an annulus near the radially outer end of the rod guide 64 is labeled 137. It will be appreciated that oil may enter each of the areas 137 since the rod 60 is lubricated via the passages 66. The oil will be returned to the sump 34 by means of a trough-like configuration 138 located below each of the areas 130 provided with a lowermost opening 140 that establishes fluid communication between the corresponding area 136 and the sump 34. Should any oil flow to the areas or spaces 141 between the respective webs 104 and rod guider 64, it may also be returned to the sump 34 by the same means.

As seen in FIG. 2, the piston 74 is fully within its cylinder 76, i.e., at a full compression position. Conversely, the piston 82, which is paired with the piston 74 on the yoke block 52, is fully retracted from its cylinder 84. In other words, the pistons that are 180° apart about the shaft 12 are 180° out of phase with each other. This is also true of the pistons 78 and 86 and those pistons are 90° and 270° out of phase with the pistons 74 and 82.

This in turn means that as, for example, the piston 72 moves toward the position illustrated in FIG. 2, the associated area 136 will be moving toward a maximum volume. At the same time, the area 136 associated with the piston 82 will be moving toward a minimal volume. Compare the two as shown in FIG. 2. In order to minimize the possibility of oil being ingested from the sump 34 as the result of an increase in the volume of one of the areas 136 and/or as a result of gas being blown into the sump 34 by one of the areas 136 that is decreasing in volume, the housing 10 is provided with a peripheral conduit, parts of which are shown in FIG. 3 and are designated 142. The conduit 142 establishes fluid communication between all of the areas 136 so that gas may be shuttled back and forth between those areas as they expand and contract during operation of the compressor. This reduces the pressure differential across each of the bellows 130. In this regard, the housing 10 may be provided with vent passages 144 in fluid communication with the exterior of various ones of the cylinder and thus the interior of the associated bellows 130.

A number of advantages accrue from the foregoing construction. First, and most importantly, the bellows 130 provides absolute positive isolation of the compression zones from the area in which oil or lubricant is present. Consequently, compressed gas provided by a reciprocating compressor according to the invention is guaranteed to be oil or lubricant free.

The specific configuration of various components provides for long life of the bellows. The bellows may be made of a material known as AM350 and are available from Metal Bellows Corporation. They are capable of undergoing $10^{11}$ cycles. Needless to say, however, it is desirable that as the bellows go from a relaxed state to a fully compressed state (as when the associated piston is moved fully within the associated cylinder) and then ultimately returned to a fully tensioned state (as when the associated piston is at its outermost position with respect to its associated cylinder), sufficient internal stress to cause metal fatigue cannot be generated. This in turn means that the bellows have sufficient length such that each pleat or fold thereof will not be overstressed during such movement.

The various features of the foregoing exemplary embodiment provide a means whereby such a length can be achieved without materially increasing the length of the rods 60 for other components of the compressor to accommodate such lengths and thereby increase the bulk of the compressor.

For example, use of the concave webs allows the webs to nest compactly about the associated rod guides 64 to minimize spacial requirements. At the same time, it allows an increase in the length of each bellows 130 equal to the offset between the peripheral lip 112 and the collar 102.

Similarly, by making the flange 114 of larger diameter than the exterior of the associated cylinder, at least in the case of the zones 16 and 18, the bellows supporting lip 116 can be disposed intermediate the ends of the cylinder thereby allowing an increase in the length of the bellows 130 equal to the displacement between the lip 116 and the end of the cylinder nearest the shaft 112. In addition, by making the diameter of the collar 102 on the web 104 sufficiently small sized, in some instances the same may be sized to actually enter one or more of the cylinders. In the embodiment illustrated, the collar 102 associated with the zone 18 may actually enter the cylinder 84. This in turn facilitates mounting of the cylinder at a location more close to the axis of rotation of the shaft 112 to provide a greater degree of compactness.

The cup-shaped webs 104 act as oil screens to prevent oil or lubricant from being splashed from the rod guide 64 against the valves and provide a means whereby such oil may drain to the trough-like configurations 138 and ultimately to the sump 34. In addition, the bellows, to some degree help maintain proper alignment of their respective rods.

Thus, a highly efficient, and reliable reciprocating compressor for providing lubricant free gas without treatment subsequent to compression is provided by the invention.

I claim:

1. A reciprocating compressor comprising:

a housing including means defining at least one cylinder;

a piston reciprocally received in said cylinder;

a drive shaft journaled in said housing;

a piston rod connected to said piston and extending toward said drive shaft;

a rotary to reciprocating motion converting mechanism interconnecting said piston rod and said drive shaft so that rotation of said drive shaft will cause reciprocation of said piston;

means for providing liquid lubricant to said converting mechanism to lubricate the same;

means for positively isolating said cylinder from said liquid lubricant for all positions of said piston within said cylinder including a bellows having opposed ends and surrounding said piston rod between said piston and said converting mechanism; and an imperforate cup-like web carried by said rod and having a peripheral lip displaced away from one of said cylinder and said converting mechanism;

one of said bellows ends being sealed to said lip and the other of said bellows ends being sealed to the other of said cylinder and said converting mechanism.

2. A reciprocating compressor comprising:

a housing including means defining at least one cylinder;

a piston reciprocally received in said cylinder;

a drive shaft journaled in said housing;

a piston rod connected to said piston and extending toward said drive shaft;

a rotary to reciprocating motion converting mechanism interconnecting said piston rod and said drive shaft so that rotation of said drive shaft will cause reciprocation of said piston;

a piston rod guide located radially outward of said converting mechanism for guiding said piston rod in a straight line path;

means for providing liquid lubricant to said converting mechanism and said rod guide to lubricate the same; and means for positively isolating said cylinder from said liquid lubricant for all positions of said piston within said cylinder including a bellows having opposed ends and surrounding said piston rod between said piston and said rod guide and a cup-shaped web secured to said rod for movement therewith and having an offset peripheral lip, one end of said bellows being secured and sealed to said peripheral lip and movable therewith, the other end of said bellows being secured and sealed to said housing.

3. A reciprocating compressor comprising:

a housing including means defining at least one cylinder;

a piston reciprocally received in said cylinder;

a drive shaft journaled in said housing;

a piston rod connected to said piston and extending toward said drive shaft;

a rotary to reciprocating motion converting mechanism interconnecting said piston rod and said drive shaft so that rotation of said drive shaft will cause reciprocation of said piston;

a piston rod guide located radially outward of said converting mechanism for guiding said piston rod in a straight line path;

means for providing liquid lubricant to said converting mechanism and said rod guide to lubricate the same; and means for positively isolating said cylinder from said liquid lubricant for all positions of said piston within said cylinder including a bellows having opposed ends and surrounding said piston rod between said piston and said rod guide, the radially inner end of said bellows being secured and sealed to said piston rod and movable therewith, the radially outer end of said bellows being secured and sealed to said housing about said cylinder;

said guide surrounding said piston rod and having a predetermined outer periphery, and said radially inner end of said bellows being mounted to a cup-like web carried by said rod, said cup-like web having a concave end facing said rod guide and having a shape capable of telescoping about said rod guide, said concave end being surrounded by a peripheral lip to which said radially inner end is secured and sealed such that the remainder of said cup-like web is within said bellows.

4. A reciprocating compressor comprising:

a housing including means defining at least one cylinder;

a piston reciprocally received in said cylinder;

a drive shaft journaled in said housing;

a piston rod connected to said piston and extending toward said drive shaft;

a rotary to reciprocating motion converting mechanism interconnecting said piston rod and said drive shaft so that rotation of said drive shaft will cause reciprocation of said piston;

a piston rod guide located radially outward of said converting mechanism for guiding said piston rod in a straight line path;

means for providing liquid lubricant to said converting mechanism and said rod guide to lubricate the same; and means for positively isolating said cylinder from said liquid lubricant for all positions of said piston within said cylinder including a bellows having opposed ends and surrounding said piston rod between said piston and said rod guide, the radially inner end of said bellows being secured and sealed to said piston rod and movable therewith, the radially outer end of said bellows being secured and sealed to said housing about said cylinder;

said cylinder including an external peripheral lip intermediate its ends and said bellows being constructed to telescope about the exterior of said cylinder, said radially outer end being secured and sealed to said peripheral lip.

5. A reciprocating compressor comprising:

a housing including means defining at least one cylinder;

a piston reciprocally received in said cylinder;

a drive shaft journaled in said housing;

a piston rod connected to said piston and extending toward said drive shaft;

a rotary to reciprocating motion converting mechanism interconnecting said piston rod and said drive shaft so that rotation of said drive shaft will cause reciprocation of said piston;

a piston rod guide located radially outward of said converting mechanism for guiding said piston rod in a straight line path;

means for providing liquid lubricant to said converting mechanism and said rod guide to lubricant the same; and means for positively isolating said cylinder from said liquid lubricant for all positions of said piston within said cylinder including a bellows having opposed ends and surrounding said piston rod between said piston and said rod guide, the radially inner end of said bellows being secured and sealed to said piston rod and movable therewith, the radially outer end of said bellows being secured and sealed to said housing about said cylinder;

a web carried by said rod and having an outer periphery to which said bellows radially inner end is secured and sealed, and an inner collar through which said rod extends, said inner collar being on the cylinder side of said web and having a periphery that may enter said cylinder as said rod reciprocates.

6. The compressor of claim 5 wherein said rod guide surrounds said piston rod and wherein said web is cup-like, having a concave end facing said rod guide and having a shape capable of telescoping about said rod guide, said concave end being surrounded by a peripheral lip to which said radially inner end is secured and sealed such that the remainder of said cup-like web is within said bellows.

7. The compressor of claim 2 wherein there are plural ones of said cylinders, pistons, piston rods, rod guides and bellows, and said converting mechanism is constructed and arranged to phase the pistons in a uniform manner; and further including at least one passage in said housing establishing fluid communication between the areas within said housing about each rod between the associated bellows and the associated rod guide.

8. A multiple stage reciprocating compressor comprising:

a housing including means defining at least two opposed cylinders;

a piston reciprocally received in each of said cylinders;

a drive shaft journaled in said housing;

a piston rod for each of said pistons and cylinders and connected to an associated piston and extending toward said drive shaft;

a rotary to reciprocating converting mechanism interconnecting said piston rods and said drive shaft so that rotation of said drive shaft will cause reciprocation of said pistons, the reciprocation of opposed ones of said pistons being 180° out of phase;

a piston rod guide for each of said piston rods mounted in said housing and located radially outward of said converting mechanism for guiding the associated piston rod in a straight line path;

means for providing a liquid lubricant to said converting mechanism and to said rod guides to lubricate the same; and means for positively isolating each said cylinder from said liquid lubricant for all positions of said pistons within the associated cylinder and including a bellows having opposed ends and surrounding an associated piston rod between the associated piston and the associated rod guide, a cup-like web carried by each said rod, each said cup-like web having a concave end facing the associated rod guide and a shape capable of telescoping about the associated rod guide, each said end being surrounded by a peripheral lip to which the radially inner end of the associated bellows is secured and sealed such that the remainder of the cup-like web is disposed within the associated bellows, at least one of said bellows being constructed to telescope about the exterior of the associated cylinder and having its radially outer ends sealed to the exterior of the associated cylinder on the exterior thereof at a location intermediate the ends thereof, at least one said web being mounted to its associated rod by a collar remote from said lip and through which said rod extends, said inner collar being on the cylinder side of said web and having a periphery sized to enter the associated cylinder as the rod on which it is mounted reciprocates.

* * * * *